US005295677A

United States Patent [19]

Hutner

[11] Patent Number: 5,295,677

[45] Date of Patent: Mar. 22, 1994

[54] SPEED CONTROL FOR DOCUMENT HANDLING SYSTEM

[75] Inventor: Mark A. Hutner, Glenview, Ill.

[73] Assignee: Videojet Systems International, Inc., Wood Dale, Ill.

[21] Appl. No.: 937,300

[22] Filed: Aug. 28, 1992

[51] Int. Cl.[5] ..... B65H 7/08

[52] U.S. Cl. ..... 271/110; 271/111; 271/265

[58] Field of Search ..... 318/68, 77, 78; 271/111, 110, 265

[56] References Cited

U.S. PATENT DOCUMENTS 4,931,712 6/1990 DiGiulio et al. .
4,935,078 6/1990 Bergman et al. .
4,959,600 9/1990 DiGiulio et al. .
5,121,915 6/1992 Duncan et al. ..... 271/111

FOREIGN PATENT DOCUMENTS 1293814 2/1987 U.S.S.R. ..... 318/77

OTHER PUBLICATIONS

"Jetstream ® II" of Cheshire/A Videojet Company, Wood Dale, Ill., a Division of the Assignee of the subject application.

"Mailing Systems" of Cheshire/A Videojet Company, Wood Dale, Ill.

Copy of ten page printout of computer-based patent search identifying ten U.S. patents relating to motor controller circuits.

*Primary Examiner*—David H. Bollinger
*Attorney, Agent, or Firm*—Welsh & Katz, Ltd.

[57] ABSTRACT

A document handling system, such as a mailing machine, includes a feeder station operative to feed documents from a stack in sequential fashion to a conveyor belt of a transport station. The feeder and transport stations include discrete drive motor controllers operatively associated with a speed control adapted to apply a control signal to the transport controller and a control signal to the feeder controller. The feeder controller signal is slaved to the transport controller signal so as to enable changes in document feeder and transport speeds through a single control. A separate gap control enables selective adjustment of the gap between successive documents for various size documents.

24 Claims, 3 Drawing Sheets

SPEED CONTROL FOR DOCUMENT HANDLING SYSTEM

BACKGROUND OF THE INVENTION

The present invention relates generally to document handling systems, and more particularly to a document handling system including a document feeder station operative to feed documents in successive one-at-a-time fashion to a transport conveyor, and having a novel system speed control enabling adjustment of both feeder and transport speeds with a single control without having to adjust the gap between successive documents.

It is a conventional practice in various document handling systems, such as mailing machines, to employ a document feeder station operative to feed documents in sequential one-at-a-time fashion from a generally vertical stack to a transport station employing at least one conveyor belt operative to convey the documents in spaced relation along a predetermined path. As the documents traverse the transport path, they generally pass one or more operating stations which perform various functions on the documents, such as applying alpha-numeric indicia to each document. Mailing systems of this general type are commercially available from Videojet Systems International, Inc., Wood Dale, Ill.

In document handling systems of the aforedescribed type, the document feeder and transport stations each typically employ a separate controller having a drive motor responsive to control signals to vary the motor speed, and thus the document feed rate (documents per hour) and transport speed (feet per minute). By selectively varying the feeder and transport drive motor speeds, variable spacing may be obtained to accommodate different size documents. Present mailing machines that have variable spacing typically use independent electronic speed controls for the feeder and transport drive motors. The speed of the feeder is set independently of the speed of the transport. If the speed of the transport is changed, the gap between documents or other pieces of media either becomes larger or smaller. This may cause a crash or jam to occur between successive documents or media pieces, or result in a loss of production because of excessive gaps. The feeder and transport drives of present mailing machines must be set by adjusting both controls and then fine tuning. The desirable approach is to set both feeder and transport speeds proportionally with a single speed control, and set the gap with another control. Thus, an inexpensive control for proportionally adjusting feeder and transport speeds manually with a single control, and adjusting the gap between successive documents with another control would provide a significant advantage over prior known mailing machines.

SUMMARY OF THE INVENTION

In accordance with the present invention, a speed control is provided for document handling systems, such as mailing machines, which employ document feeder and transport stations. The speed control of the present invention allows an operator to set the system speed, that is, the feeder and transport motor speeds, with a single adjustment. In a preferred embodiment of the invention, an input control voltage of 0–10 volts is employed with 10 volts applied to feeder and transport motor controllers causing feeder and transport drive motors to reach maximum speed. Holding the gap between successive documents generally constant for different size documents, or when changing the transport speed to either slow down or speed up the transport rate, requires raising or lowering the input voltages to feeder and transport control circuits together by the same ratio, i.e. proportionally. In accordance with the present invention, relatively inexpensive feeder and transport drive motor controllers may be employed which have nonlinear speed response to an initial applied control voltage range, such as 0 to 1 volt, thereby requiring a threshold voltage of approximately 1 volt to cause the motors to begin motion. Thus, holding the gap constant by raising or lowering both feeder and transport control voltages together does not work with a reference voltage starting at 0 volts because the speed controllers require approximately 1.0 volt to cause the drive motors to begin motion. The present invention overcomes this problem by incorporating a variable offset which has a 0 to 2 volt range and is additive to a ground reference voltage for the drive motor controllers. With the offset adjusted to 1 volt, both feeder and transport controllers will track proportionally if the input voltage is changed linearly. Without the offset, this is not the case. That is, with the feeder and transport drive motor controllers being nonlinear below approximately 1.0 volt, raising the control voltages by equal percentages, such as 50%, will not result in a proportional change in the motor speeds.

In accordance with the present invention, mechanical drive ratios are set for the feeder and transport controllers so as to establish a predetermined feeder cycle rate, such as 30,000 documents per hour, for a predetermined size document with a full applied voltage of 10 volts on the feeder controller. A predetermined transport rate, such as 560 feet per minute, is established for the transport conveyor with the same size documents when the full 10 volt control voltage is applied to the transport controller. Thus, maximum feeder speed and maximum transport speed can be achieved simultaneously in response to application of the full or maximum supply voltage to the controllers. For smaller size documents, the transport speed must be reduced to maintain a similar gap between successive documents with the feeder feeding documents at its maximum set feeder rate. Conversely, for larger size documents, the feeder must be slowed to maintain a similar gap between successive documents with the transport operating at maximum voltage to achieve maximum document transport speed.

In order to control both the feeder and transport drive motors with a single control, the present invention slaves one speed control, such as a feeder control, to the other control, such as the transport control, with either speed control adapted to receive maximum voltage input while the other may have a reduced applied voltage. This is accomplished by setting the feeder control input voltage as a percentage of the transport speed control input voltage. This setting is done with a gap control potentiometer. In the case where full input voltage is applied to both the feeder and transport speed controllers to achieve a desired gap for a given first document size, i.e., the feeder control voltage is set at 100% of the transport input voltage, reducing the feeder controller voltage by 50% through the potentiometer enables feeding of documents which are double the size of the first documents. However, mere adjustment of the gap control potentiometer will not work for the case where the feeder controller voltage must be higher than the transport controller voltage, such as for feeding documents which are approximately one-half the size of the first documents. In accordance with another feature of the present invention, this problem is overcome by a voltage multiplier stage coupled to the gap control potentiometer. The output of the voltage multiplier serves as the feeder controller input. By using this technique, an input of only 4 volts to the transport controller will result in a full 10 volts at the feeder controller input if the gap control potentiometer is at maximum setting. This is sufficient for the smallest practical spacing.

Accordingly, one of the primary objects of the present invention is to provide a novel speed control for a document handling system employing document feeder and transport stations, and wherein the speed control enables simultaneous adjustment of both feeder and transport speeds with a single control without having to adjust the gap between successive documents.

Another object of the present invention is to provide a novel speed control for a document handling system wherein a single speed control is operative to set both feeder and transport speeds simultaneously, and includes control means enabling setting of the gap between successive documents by a separate control to accommodate different size documents.

Another object of the present invention is to provide a novel and inexpensive speed control for a document handling system wherein the speed control enables control of document feeder and transport drives through a single adjustable control, and also facilitates use of relatively inexpensive feeder and transport drive motor controllers which have nonlinear response over an initial input voltage range.

A more particular object of the present invention is to provide a novel speed control for controlling a document handling system employing a document feeder station and a document transport station having separate control motors, and wherein the speed control enables use of relatively inexpensive feeder and transport motor controllers which have nonlinear operating characteristics below a predetermined threshold voltage, the speed control in accordance with the invention providing an offset voltage which effects linear proportionality in motor speed changes in response to linear changes in the input voltages to the feeder and transport drive motor controllers within a predetermined voltage range.

A feature of the speed control in accordance with the present invention lies in providing a voltage multiplier circuit which enables the feeder and transport controllers to be slaved to each other so that either may have maximum input voltage applied thereto with the other receiving a lower input voltage.

Further objects, features and advantages of the present invention, together with the organization and manner of operation thereof, will become apparent from the following detailed description of the invention taken in conjunction with the accompanying drawings wherein like reference numerals designate like elements throughout the several views.

DETAILED DESCRIPTION

Figure 1:
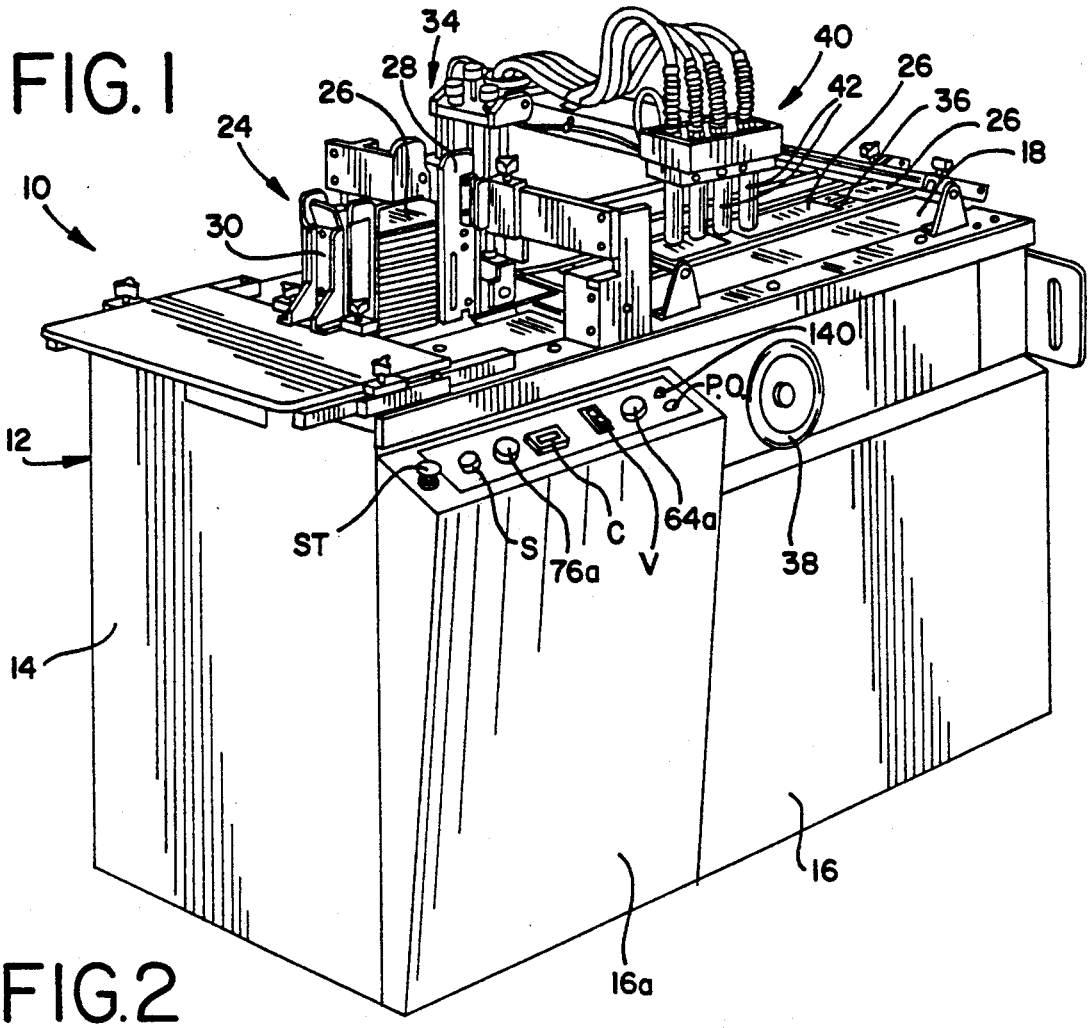
FIG. 1 is a perspective view of a mailing machine incorporating a gap control in accordance with the present invention.

Referring now to the drawings, and in particular to FIG. 1, the present invention is illustrated, by way of example, embodied in a document handling system or apparatus indicated generally at 10. In the illustrated embodiment, the document handling system 10 takes the form of a mailing machine the mechanical features of which are generally known and commercially available from Videojet Systems International, Inc., Wood Dale, Ill. The mailing machine includes a generally rectangular base 12 having substantially vertical end walls, one of which is indicated at 14, a front wall 16 and a substantially horizontal upper support plate 18. A control panel 20 is supported on the upper end of a forwardly projecting portion **16*a* of the front wall 16** and supports various operating control knobs and buttons as will be described.

The mailing machine 10 includes a document feeder station 24 supported on the upper support plate 18. The document feeder station 24 is of conventional design and is adapted to receive and support a plurality of documents, such as mailing envelopes or other pieces of media indicated at 26, in a generally vertical stack. The documents 26 are stacked between upstanding laterally adjustable side guides, one of which is indicated at 28, such that forward or lead edges of the documents engage an upstanding gate member (not shown) and the rearward edges of the stacked documents are engaged by a rear backstop 30 which is preferably adjustable longitudinally of the support plate 18 to accommodate different size documents, such as different size mailing envelopes or other pieces of media.

The document feeder station 24 includes document feeder means, indicated generally at 34, operative to feed documents 26 from the stack in sequential one-at-a-time fashion to a transport station in the form of one or more conveyor or transport belts, one of which is indicated at 36. The conveyor belts have upper generally coplanar rectilinear reaches to receive the documents and transport them in sequential fashion along a predetermined path. The document feeder means 34 is of the type disclosed in U.S. Pat. Nos. 5,703,846 and 5,199,699, both of which are assigned to the assignee of the present invention and are incorporated herein by reference. The document feeder means 34 includes a shuttle plate (not shown) of known design which is supported for reciprocating movement beneath the stack of documents 26 and is driven by a D.C. feeder drive motor, indicated schematically at 37 in FIG. 3. The shuttle plate is responsive to control signals applied to a feeder drive motor controller to reciprocate in a direction parallel to the conveyor belt 26 and feed successive bottom documents in the stack to the transport station conveyor belts 36, as is known. The document feeder means 34 also includes at least one pair of mutually cooperable feed rolls (not shown) which define a nip to receive successive bottom documents from the stack and assist in feeding the documents in sequential fashion onto an input end of the conveyor belt 36 of the transport station. A hand wheel 38 is mounted on the base 12 and is releasably interconnected to the feed rolls to enable an operator to manually operate the feed rolls during set up. As will be described, the feeder drive motor 37 is controlled by a speed control as illustrated schematically in FIG. 4. The feeder shuttle plate and feed rolls are described in greater detail in the aforementioned U.S. Pat. No. 5,199,699.

The conveyor belt 36, and any parallel coplanar conveyor belts comprising the transport station, are reeved over and extend between a transverse drive roll (not shown) and a transverse idler roll (not shown) in a manner as disclosed in U.S. Pat. No. 5,199,699. The drive roll is fixed on a transverse drive shaft supported by the base 12 and rotatably driven by a transport drive motor, indicated schematically in FIG. 3 at 39, through a timing belt in the manner as disclosed in U.S. Pat. No. 5,199,699 such that an upper reach of the conveyor belt 36 receives documents from the feeder station and transports the documents along a rectilinear path. If desired, the conveyor belt 36 may have longitudinally spaced openings therethrough which pass over a vacuum manifold (not shown) to effect vacuum gripping of documents received from the feeder means 34 and conveyed along the conveyor path. As the documents are conveyed along the transport path, they may pass one or more operating stations having means to perform a function on the conveyed documents. In the illustrated embodiment, the documents conveyed along the transport station pass in underlying relation to a printing station 40 having a plurality of non-contact printing heads in the form of ink jet print heads, four of which are indicated at 42. The ink jet print heads are supported such that their longitudinal axes lie in a plane disposed substantially perpendicular to the plane of the upper reach of conveyor belt 36 and parallel to the direction of movement of documents as they are conveyed through the transport station. The ink jet print heads 42 are of conventional design, such as commercially available from the Videojet Systems International, Inc., and are operative to selectively print alpha-numeric indicia on the documents 26 as they pass the print heads, as is known.

It will be appreciated that with a mailing machine of the aforedescribed type, different size documents may be accommodated by selectively varying the document feeder and transport drive motor speeds while maintaining desired spacing between successive documents conveyed along the transport station. In accordance with prior mailing machines, independent electronic speed controls are employed with the feeder and transport drive motors. To accommodate different size documents, the speed of the feeder has to be set independently of the speed of the transport. If the speed of the transport is changed without a change in feeder speed, the gap between documents or other pieces of media either becomes larger or smaller with the result that a crash or jam can occur between successive documents, or excessively large gaps are established between successive documents with resultant loss in production rate. To alleviate this problem, the feeder and transport drives of prior mailing machines have to be set by adjusting both controls and fine tuning the system. In accordance with one feature of the present invention, both the feeder and transport controller drive motors can be varied in direct proportion to each other with a single speed control, and the gap between successive documents set with a separate control. A significant advantage of the present invention lies in the ability to employ relatively inexpensive feeder and transport controllers which may be nonlinear in operation over an initial voltage input range less than a predetermined threshold voltage.

Figure 3:
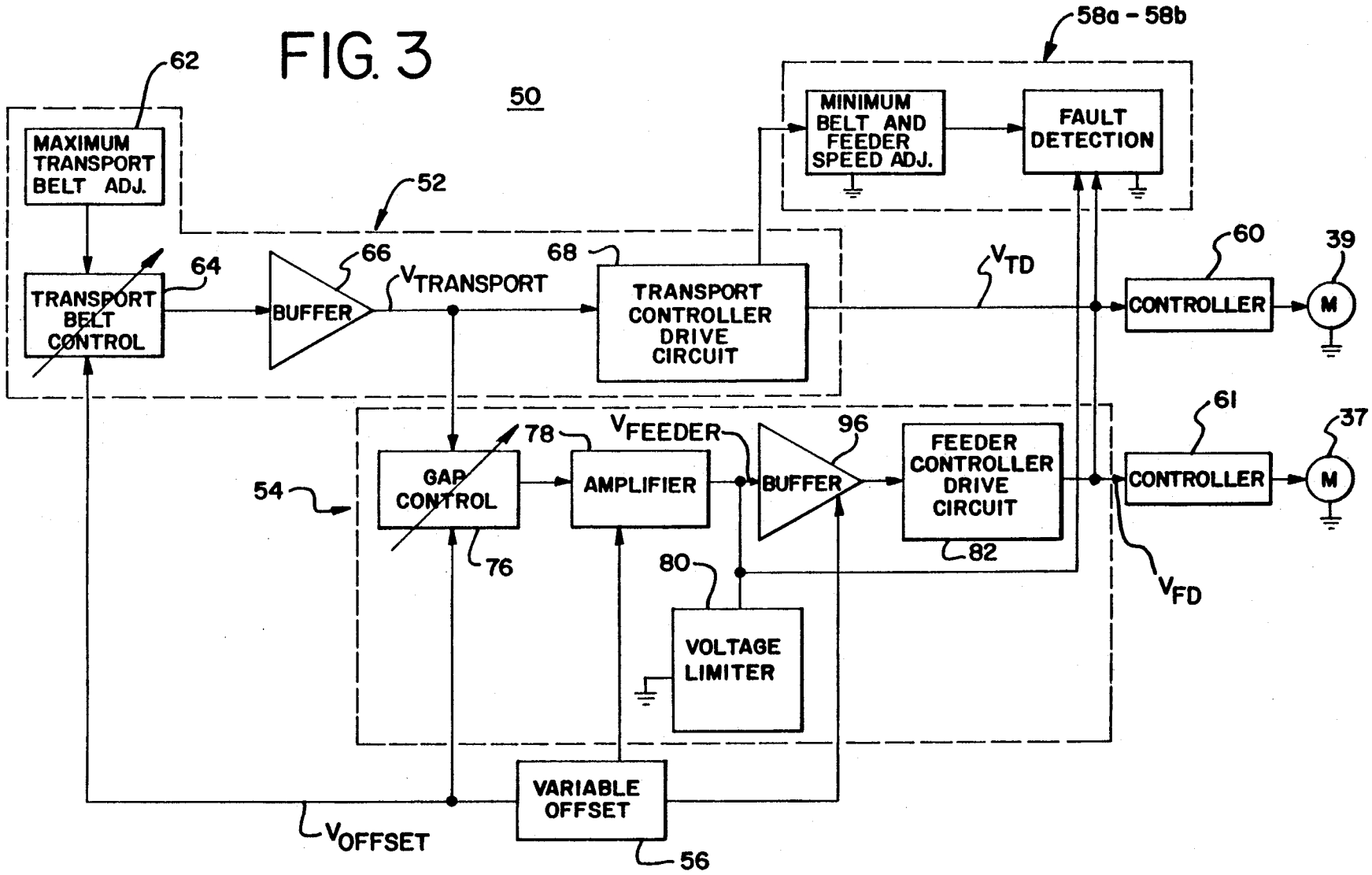
FIG. 3 is a block diagram of the speed control shown in FIG. 4.
Figure 4:
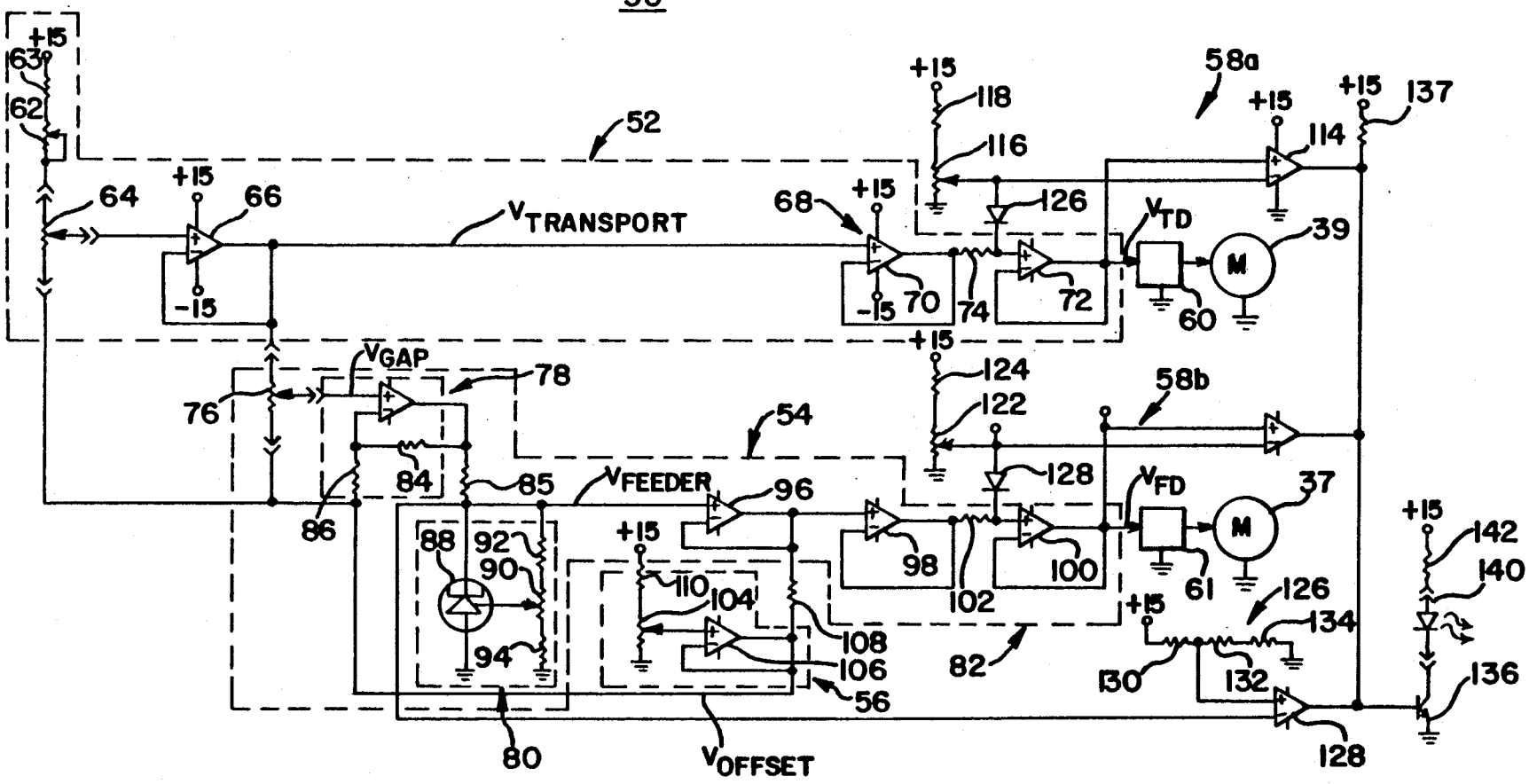
FIG. 4 is a circuit diagram of a speed control in accordance with the present invention.

FIGS. 3 and 4 illustrate a speed control 50 for use with the document handling system or apparatus 10 and which, in the illustrated embodiment, includes an adjustable transport control circuit 52, an adjustable feeder control circuit 54 slaved to the transport control circuit 52, a variable voltage offset circuit 56 coupled to both the transport control circuit 52 and the adjustable feeder control circuit 54, and a fault detection circuit with an integrated minimum conveyor belt and feeder speed control circuit **58*a*–58*b* also coupled to both the transport control circuit 52 and the adjustable feeder control circuit 54. The transport control circuit 52 outputs a drive signal ($V_{TD}$) to a transport controller 60 which controls the transport drive motor 39. The slaved feeder control circuit 54 outputs a drive signal ($V_{FD}$) to a feeder controller 61 which controls the feeder drive motor 37. The controllers 60 and 61** may be of the type KB-MM225, manufactured by K. B. Electronics.

As best seen in FIG. 4, the transport control circuit 52 includes an adjustable trim resistor 62 for setting the maximum belt speed of the transport belt. A series resistor 63 connects the trim resistor 62 to a positive power supply. The adjustable trim resistor 62 also couples to a system speed control resistor pot 64 or other variable resistance device, which is used to adjust both the desired transport belt speed and feeder shuttle plate speed. A buffer 66, such as an operational amplifier configured as a voltage follower as known in the art, receives its input voltage from across the system speed control resistor pot 64. The buffer 66 may be one of four op-amps from a quad op-amp package. The output signal from the buffer 66 $V_{transport}$ serves as the input signal to a transport drive circuit generally indicated at 68 and also serves as the input signal to the adjustable feeder control circuit 54. Hence, a slave relationship is established between the transport control circuit and the feeder control circuit.

The transport drive circuit 68 includes a pair of serially connected op-amps 70 and 72 also configured as voltage followers and separated by resistor 74. The output of the first op-amp 70 serves as the input, through resistor 74, to the second op-amp 72. The output signal from the second op-amp 72 serves as $V_{TD}$ for the transport controller 60.

Feeder control circuit 54 includes a gap control potentiometer 76 and a voltage multiplier circuit, or amplifier, generally indicated at 78. The output ($V_{feeder}$) of the amplifier 78 couples to a voltage limiter circuit 80 for setting the maximum feeder speed through a resistor 85 and a feeder controller drive circuit, generally indicated at 82, through a feeder buffer 96. The amplifier circuit 76 multiplies its input voltage ($V_{gap}$) by approximately 2.5 based on the value of resistors 84 and 86 as known in the art.

The voltage limiter circuit 80 includes an adjustable regulator 88 whose control pin is coupled to a trim pot 90 for setting the maximum feeder input voltage. Resistors 92 and 94 serve as current limiting resistors and are used to set a reference voltage via a voltage divider with the trim pot 90, as known in the art. In the preferred embodiment, the voltage limiter circuit 80 is adjusted so that $V_{feeder}$ does not exceed 10 volts. The feeder input voltage $V_{feeder}$ is input into the feeder buffer 96 or voltage follower circuit, whose output serves as the input to the feeder drive circuit 82.

The feeder drive circuit 82 is substantially identical to the transport drive circuit 68 as previously described. The output of the feeder drive circuit 82 serves as the feeder control signal to the feeder controller 61. The feeder drive circuit 82 includes a first op-amp 98 and second op-amp 100 which are connected in series through a resistor 102.

The variable offset circuit 56 includes an offset adjust trim pot 104 operatively coupled to the input of an op-amp 106 which is configured as a voltage follower. The voltage offset couples to the gap control resistor pot 76, the amplifier 78 and an isolation resistor 108. The output signal of the op-amp 106 is coupled to the isolation resistor 108 which is in series with the output of the feeder buffer 96. The output of the op-amp 106 also couples to the resistor 86 of the amplifier 78 and the gap control pot 76 and further couples to the transport speed control pot 64. The offset adjust trim pot 104 is connected to a current limiting resistor 110 which is coupled to the positive supply voltage which sets up a voltage divider as known in the art. The offset voltage $V_{offset}$ of the op-amp 106 serves to raise $V_{TD}$ and $V_{FD}$ of the adjustable transport control circuit 52 and the adjustable feeder control circuit 54 above the reference ground level of the respective controllers 60 and 61 so that the controllers have a one volt potential which is the threshold for motion. This effectively allows linear proportional operation of the feed and transport drive motors when a higher control voltage is output to the controllers. The variable offset feature allows various controllers to be used since various controllers may require differing offset voltage levels.

Fault detection circuit 58*a* compares an adjustable threshold voltage to $V_{TD}$ to indicate whether the belt speed for the transport belt is above a predetermined minimum speed level. The fault detection circuit 58*a* includes a comparator 114 having its positive input terminal connected to $V_{TD}$ and having its negative input terminal connected to an adjustable trim pot 116 which serves as an adjustable voltage divider in conjunction with series resistor 118 as is known.

In a similar manner, fault detection circuit 58*b* compares the $V_{FD}$ to a threshold voltage to determine whether or not the drive voltage for the feeder motor is above a predetermined threshold. The fault detection circuit 58*b* includes an op-amp 120 having a positive input terminal connected to $V_{FD}$. The negative input of the op-amp 120 connects to a variable trim pot 122 which may be adjusted to set the minimum feeder speed. The trim pot 122 in conjunction with the series resistor 124 serves as an adjustable voltage divider and determines a minimum feeder voltage threshold.

A maximum feeder voltage fault detection circuit 126 includes a comparator 128 which determines whether $V_{feeder}$ exceeds a predetermined threshold. A voltage divider including resistors 130, 132 and 134 determines the voltage threshold level.

The outputs of all the fault detection circuits 58*a*, 58*b*, and 126 are connected together in an OR configuration and serve as input signals to a transistor 136 which turns on an LED 140 to indicate proper gap tracking. All of the fault detection circuit outputs are also coupled to a resistor 137. A current limiting resistor 142 limits current to the LED 140 when it is on.

When any of the fault detection circuits de-activates the LED 140, the operator knows that the speed control is not maintaining the proper gap. For example, when the speed control resistor pot 64 is rotated to a point where the minimum transport belt speed is reached, the LED 140 is turned off. This corresponds to the transport belt no longer slowing down and the gap will increase as the control resistor pot 64 is adjusted to slow the system speed down.

Referring again to the fault detection circuits 58*a* and 58*b*, the minimum transport speed control circuit and the minimum feeder speed control circuit include rectifiers 126 and 128 coupled to the positive input of op-amps 72 and 100, respectively. The rectifiers conduct current when $V_{transport}$ and $V_{feeder}$ drop below a predetermined level as dictated by respective voltage divider circuits as previously described.

The rectifiers 126 and 128 cause a minimum control signal $V_{FD}$ to be output by the speed control even when no $V_{transport}$ or $V_{feeder}$ is present. This allows the transport drive motor and feeder drive motors to slowly move the conveying mechanism so that an operator can see that power is still applied to the system.

Suitable electrical components for the speed control 50 are shown in Table I. However, it will be recognized that component values may be varied to facilitate a given application.

TABLE I

| Reference Number | Description |
|---|---|
| 85 | RESISTOR, CARBON FILM .25 W 470 |
| 86, 142 | RESISTOR, CARBON FILM .25 W 1K |
| 63, 84 | RESISTOR, CARBON FILM .25 W 1.5K |
| 108, 130, 132, 134, 137 | RESISTOR, CARBON FILM .25 W 10K |
| 94 | RESISTOR, CARBON FILM .25 W 27K |
| 118, 124 | RESISTOR, CARBON FILM .25 W 39K |
| 74, 102 | RESISTOR, CARBON FILM .25 W 47K |
| 110 | RESISTOR, CARBON FILM .25 W 68K |
| 92 | RESISTOR, CARBON FILM .25 W 100K |
| 64, 76 | CONTROL POT, 5K |
| 62, 90, 104, 116, 122 | TRIMPOT, BOURNS 3299, 10K |
| 66, 78, 96, 106 70, 72, 98, 100 | LM324, QUAD OPERATIONAL AMPLIFIER |
| 88 | TL431, ADJUSTABLE REGULATOR |
| 114, 120, 128 | LM339, QUAD COMPARATOR |
| 136 | 2N4401, TRANSISTOR, NPN |
| 126, 128 | 1N4001, DIODE |
| 140 | LED |

The power supply may be any suitable power supply such as a dual 15V/−15V DC supply.

As seen in FIG. 4, the voltage across the system belt speed control pot 64 serves as the input voltage to buffer 66. The output of buffer 66 serves as the transport belt input voltage ($V_{transport}$) to its transport belt drive circuit 68.

The output of the buffer 66 ($V_{transport}$) also serves as the input to the gap control potentiometer 76. The voltage ($V_{gap}$) across the gap control potentiometer 76 serves as the input to the amplifier 78. The output voltage ($V_{feeder}$) from the multiplier 78 serves as the input to the buffer 96. The output voltage from the buffer 96 serves as the input to the feeder drive circuit 82.

The transport drive motor voltage $V_{OUTT}$ serves as one input to comparator 114 and the minimum transport belt voltage serves as the other input voltage to the comparator 114. When $V_{OUTT}$ falls below the set minimum belt speed voltage, the LED 140 is turned off indicating a fault detection. Conversely, when $V_{OUTT}$ exceeds the predetermined minimum transport belt speed voltage, the output of 114 goes high enabling LED 140 to turn on thereby indicating normal operation. The output drive voltage $V_{OUTF}$ for the feeder motor is compared to the predetermined minimum voltage via comparator 120 in a similar manner as described with reference to the comparator 114.

The $V_{feeder}$ fault detection mechanism 126 compares $V_{feeder}$ to a predetermined voltage threshold as set by the voltage divider formed by resistors 130, 132 and 134. When the $V_{feeder}$ is above the threshold voltage, the comparator 128 turns off the transistor 136 which turns off LED 140, thereby indicating a fault. Conversely, when $V_{feeder}$ exceeds the predetermined threshold voltage, the comparator 128 enables the transistor 136 to turn on LED 140. It will be recognized that since the outputs of all three fault detection circuits 58a–58b and 126 are coupled together, any circuit may turn the transistor 136 off although other of the circuits may not detect a fault.

The variable offset circuit 56 has an adjustable input voltage determined by the voltage divider circuit formed by resistor 110 and offset trim pot 104. The output of the offset circuit is coupled to both the adjustable transport control circuit 52 and adjustable feeder control circuit 54.

At the factory certain parameters are initially set. For example, the factory may initially set the maximum belt speed for the transport belt by adjusting the adjustable trim resistor 62 so that a maximum predetermined voltage may be applied to the system belt speed control pot 64. Similarly, the maximum feeder speed may be set by adjusting the adjustable feeder trim resistor 90 so that the voltage regulator 88 does not allow $V_{feeder}$ to exceed a predetermined maximum voltage.

The minimum transport belt speed may be set by adjusting the minimum belt speed control pot 116.. Likewise, the minimum feeder speed may be set by adjusting the minimum feeder speed control pot 122.

To operate the document handling system 10 for a given document size, an operator adjusts the system control potentiometer 64 to reduce the transport speed. Next, the gap control potentiometer 76 is adjusted to set the desired gap. Finally, the operator increases the system speed to the desired speed, re-adjusting the system control potentiometer 64. The above steps may be used when different size documents need to be sorted.

When speed adjustment is required, the operator merely adjusts the system speed control 64 which is adjustable through a corresponding control 64a on the control panel 20. For example, when a downstream operation requests or necessitates that the documents be moved along the transport station at a slower rate, the operator turns the system speed potentiometer 64 to reduce system speed. Since the feeder control voltage is a function of the transport control voltage, the feeder will automatically adjust to the change in transport speed to maintain the selected gap.

In addition to the system speed control 64a, the control panel 20 also has a power on or start button "S" which turns the system power on. A power off or stop control "ST" enables the operator to readily turn the system power off. A median spacing or gap control 76a is operatively associated with the gap control pot 76 to enable operator adjustment of the gap between successive documents fed from the feeder to the transport conveyor belts. If desired, a counter "C" may be provided to indicate the number of documents fed from the feeder station for a given run. A vacuum on control "V" enables control of vacuum to a conveyor belt vacuum manifold. The spacing active LED 140 and a power on indicate light "P.O." are also mounted on the control panel for easy operator viewing.

The operation of the speed control 50 may be further understood by way of example using three scenarios. It will be assumed that control signals $V_{TD}$ and $V_{FD}$ range from 1VDC at zero speed to 10VDC at full speed so that half speed occurs at 5.5VDC. Assuming a 1" gap between documents, the following three scenarios will be explained:

SCENARIO A: 12.44" document length yields a 13.44" total length which requires a $V_{TD}$=10VDC to maintain 560 ft./min. and a $V_{FD}$=10VDC to maintain 30,000 documents/hour;

SCENARIO B: 5.72" document length yields a 6.72" total length which requires a $V_{TD}$=5.5VDC to maintain 280 ft./min. and a $V_{FD}$=10VDC to maintain 30,000 documents/hour; and SCENARIO C: 25.88; " document length yields a 26.88" total length which requires a $V_{TD}$=10VDC to maintain 560 ft./min. and a $V_{FD}$=5.5VDC to maintain 15,000 documents/hour.

For the speed control 50 to function properly, $V_{feeder}$ should be set as a percentage of $V_{transport}$. This may be accomplished using the gap control potentiometer 76. For SCENARIO A, $V_{feeder}$ may be set at 100% of $V_{transport}$. For SCENARIO C, $V_{feeder}$ may be set at 50% of $V_{transport}$. However, where $V_{feeder}$ must be at a higher voltage than $V_{transport}$, such as SCENARIO B, the amplifier 78 multiplies $V_{transport}$ by approximately 2.5 so that $V_{transport}$ can be at a lower voltage than the required $V_{feeder}$.

Figure 2:
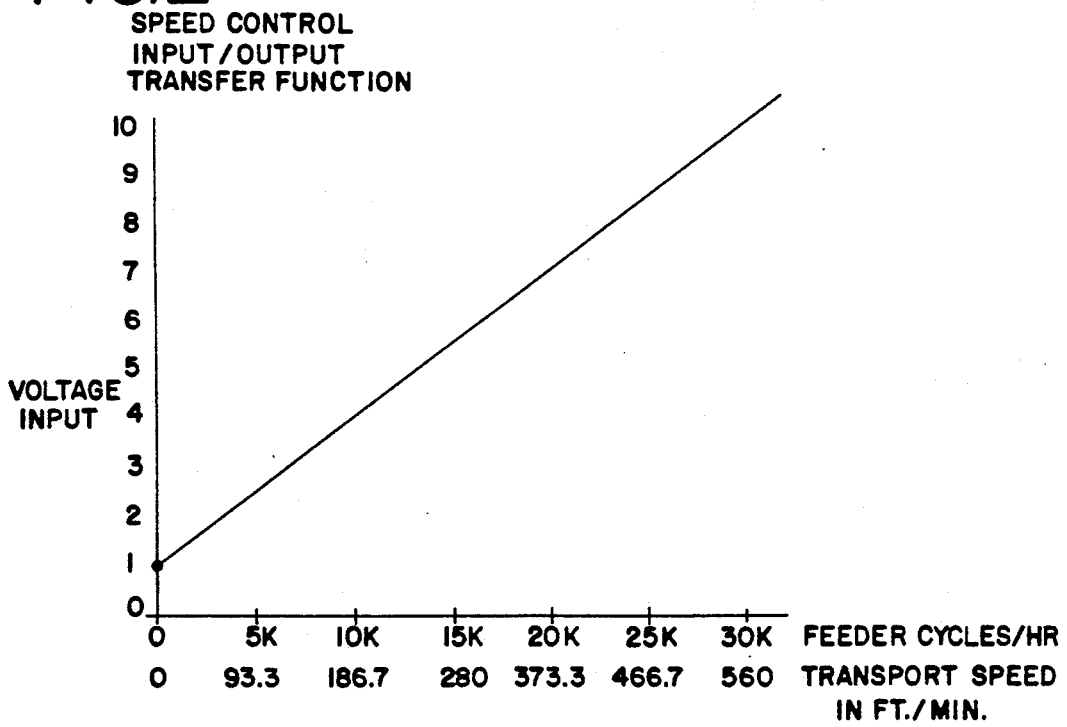
FIG. 2 is a graph showing the relationship of feeder cycles and transport speed to input voltage obtained with the speed control of FIG. 3.

The speed control of FIG. 4 has a transfer function as generally depicted in FIG. 2 and described in the above three scenarios. For example, with $V_{transport}$=4VDC, the feeder motor will operate at approximately 10,000 cycles/hour and the transport motor will operate to provide a transport belt speed of approximately 186.7 feet per minute.

It will be recognized that although the speed control 50 has been explained as a discrete analog circuit, a digitally based circuit may also be used. For example, a microprocessor may be used to determine the proper feeder control signal based on a look up table or other suitable method to generate a proportional feeder control signal based on the transport control signal.

Thus, in accordance with the present invention, a relatively inexpensive speed control is provided for use with a document handling system having a feeder station and transport station operative to convey documents, such as mailing envelopes or other media pieces, in sequential one-at-a-time fashion from a stack along a conveyor path during which one or more operations can be performed on the documents. The speed control in accordance with the invention lends itself particularly to the use of relatively inexpensive feeder and transport drive motor controllers which are generally nonlinear below a certain threshold voltage, and facilitates adjustment of the feeder and transport speeds with a single control without having to adjust the gap between successive documents.

While a preferred embodiment of the invention has been illustrated and described, it will be understood that changes and modifications may be made therein without departing from the invention in its broader aspects.

Various features of the invention are defined in the following claims.

What is claimed is:

1. In a document handling system including a document feeder station adapted to support a stack of generally flat documents, and a transport station having conveyor means defining a transport path, the feeder station having a feeder controller operative in response to a feeder control signal to effect feeding of documents in sequential fashion from the stack to the conveyor means, the transport station having a transport controller operative in response to a transport control signal to actuate the conveyor means at a speed operative to establish a gap between successive documents received from the feeder station; the combination therewith comprising speed control means including first control means operable to apply a transport control signal to said transport controller, and second control means operative to apply a feeder control signal to said feeder controller that is proportional to said transport control signal, said speed control means including means enabling adjustment of said transport control signal with simultaneous proportional adjustment of said feeder control signal.

2. A document handling system as defined in claim 1 wherein said second control means includes means for amplifying said transport control signal to produce said feeder control signal.

3. A document handling system as defined in claim 1 wherein said speed control means includes means operatively coupled to said first and second control means for generating an offset voltage, and means for adding said offset voltage to said transport control signal and to said feeder control signal.

4. A document handling system as defined in claim 1 wherein said speed control means includes gap control means enabling adjustment of the gap between successive documents fed from said feeder station to said transport station.

5. A document handling system as defined in claim 1 wherein said speed control means includes indicator means operative to provide a visual indication when said transport control signal or said feeder control signal is within a predetermined voltage signal range.

6. A document handling system as defined in claim 1 wherein said feeder and transport stations includes discrete drive motors responsive to said feeder and transport control signals, said speed control means including means limiting the maximum voltage control signals which can be applied to said transport and feeder controllers.

7. In a document handling system having a feeder station operative in response to a feeder control signal to sequentially feed documents from a stack, and a transport station including conveyor means operative in response to a transport control signal to convey documents from the feeder station along a transport path, the combination therewith comprising speed control means including first variable control means for generating a transport control signal, second variable control means for generating a feeder control signal, means operatively coupled to said first and second variable control means for generating an offset voltage, and means for adding said offset voltage to said transport control signal and to said feeder control signal.

8. A document handling system as defined in claim 2 wherein said first variable control means comprises variable resistance means operative to vary said transport control signal.

9. A document handling system as defined in claim 8 wherein said second variable control means comprises variable resistance means operative to vary said feeder control signal.

10. A document handling system as defined in claim 7 wherein said means operatively coupled to said first and second variable control means comprises voltage follower means having a variable input voltage and an output coupled to said first and second variable control means.

11. A document handling system as defined in claim 7 wherein said speed control means includes a feeder controller, and means operative to apply a feeder control signal to said feeder controller that is proportional to said transport control signal.

12. A document handling system as defined in claim 11 wherein said speed control means further includes means enabling adjustment of said transport control signal in a manner to simultaneously adjust said feeder control signal proportionately.

13. A document handling system as defined in claim 11 wherein said means operative to apply a feeder control signal to said feeder controller includes amplifier means operative to act on said transport control signal and establish said feeder control signal.

14. A document handling system as defined in claim 7 wherein said speed control means includes indicator means comprising comparator means operatively coupled to said first and second variable control means for indicating when predetermined threshold voltage levels have been reached.

15. A speed control for use with a document handling system including a document feeder station operative in response to a feeder control signal to feed documents from a stack, and a transport station having conveyor means operative in response to a transport control signal to convey documents from the feeder station along a transport path, said speed control including first circuit means operable to generate a transport control signal, second circuit means operative to establish a feeder control signal that is proportional to said transport control signal, and means enabling adjustment of said transport control signal so as to simultaneously adjust said feeder control signal proportionally.

16. A speed control as defined in claim 15 including amplifier means operative to act on the transport control signal and establish said proportional feeder control signal.

17. A speed control as defined in claim 15 including means operatively coupled to said first and second circuit means for generating an offset voltage, and means for adding said offset voltage to said transport control signal and to said feeder control signal.

18. A speed control as defined in claim 17 wherein said first circuit means includes variable resistance means operative to vary said transport control signal.

19. A speed control as defined in claim 18 wherein said second circuit means includes variable resistance means operative to vary said feeder control signal.

20. A speed control as defined in claim 17 wherein said means operatively coupled to said first and second circuit means for generating said offset voltage comprises voltage follower means having a variable input voltage and an output coupled to said first and second circuit means.

21. A speed control as defined in claim 15 further including means enabling adjustment of said transport control signal in a manner to simultaneously adjust said feeder control signal proportionately.

22. A speed control as defined in claim 15 wherein said second circuit means includes amplifier means operative to act on said transport control signal and establish said feeder control signal.

23. A speed control as defined in claim 15 further including indicator means operative to provide a visual indication when said transport control signal or said feeder control signal is within a predetermined voltage signal range.

24. A document handling system comprising, in combination, a transport station including conveyor means, a feeder station operative to feed documents from a stack in sequential fashion to said conveyor means, a discrete drive motor controller operatively associated with each of said feeder and transport stations, each said drive motor controller including a speed control adapted to apply a control signal to its corresponding transport station motor controller or feeder station motor controller, said feeder station motor controller being slaved to the transport station motor controller so as to enable changes in document feeder and transport speed through actuation of either of said motor controller, and gap control means enabling adjustment of the gap between successive documents so as to accommodate different size documents.

* * * * *